United States Patent [19]

Paurat

[11] 4,173,836

[45] Nov. 13, 1979

[54] CONDITION RESPONSIVE TRENCH EXCAVATOR

[76] Inventor: Friedrich W. Paurat, Nordstrasse 73, D-4223 Voerde 2, Fed. Rep. of Germany

[21] Appl. No.: 868,733

[22] Filed: Jan. 12, 1978

[30] Foreign Application Priority Data

Jan. 12, 1977 [DE] Fed. Rep. of Germany ..... 2700950

[51] Int. Cl.[2] ..... E02F 5/04

[52] U.S. Cl. ..... 37/81; 37/91; 37/DIG. 1; 172/3; 299/1; 299/41

[58] Field of Search ..... 37/DIG. 1, 80 R, 81, 37/82, 86, 91, 92, 93; 299/41, 1; 172/2, 3, 4, 7

[56] References Cited

U.S. PATENT DOCUMENTS 3,354,660 11/1967 Vaughan ..... 299/1 X

FOREIGN PATENT DOCUMENTS 1897894 5/1964 Fed. Rep. of Germany ..... 37/81
7618210 10/1976 Fed. Rep. of Germany ..... 37/81
155139 11/1963 U.S.S.R. ..... 37/DIG. 1
172242 12/1965 U.S.S.R. ..... 37/DIG. 1
204922 5/1968 U.S.S.R. ..... 37/DIG. 1
394509 11/1974 U.S.S.R. ..... 37/DIG. 1

*Primary Examiner*—Clifford D. Crowder
*Attorney, Agent, or Firm*—Karl F. Ross

[57] ABSTRACT

A trench excavator has a raisable and lowerable boom swingable about a vertical axis on the self-propelled chassis which is mounted on tracks. The boom carries a cutting head which is swingable about a horizontal axis at the free end of the boom so that the excavator tool can be inclined downwardly toward the chassis. According to the invention, the inclination of the cutting head is measured and the measurement is used to control the drive for the track.

7 Claims, 4 Drawing Figures

CONDITION RESPONSIVE TRENCH EXCAVATOR

FIELD OF THE INVENTION

The present invention relates to a trench-excavating machine and, more particularly, to a self-propelled excavating machine of the type in which an excavating head is swingably mounted at the end of a boom.

BACKGROUND OF THE INVENTION

It is known to provide self-propelled trench-excavating machines having a chassis carrying a prime mover, such as an internal combustion engine, and mounted upon tracks which are driven indirectly by this prime mover, e.g. through a gear or hydraulic transmission. The chassis can carry a turntable which is rotatable about a vertical axis and on which a boom can be raised and lowered, i.e. swung about a horizontal axis.

At the end of the boom remote from the chassis, there may be swingably mounted a cutting head which can have, for example, a cutting tool rotatable about the axis of this head. The head may be swingable about a horizontal axis relative to the boom and hence the axis of the cutting tool may be varied in its orientation with respect to the ground in which the trench is to be excavated. For example, the cutting tool can be lowered into the ground to commence an excavation with its axis substantially vertical and then can be inclined to widen, lengthen or otherwise enlarge the trench. The soil and detritus loosened by the tool can be removed by a conveyor which can be positioned in the trench or hole.

A trench-digging machine of this type has been described in German utility model (Gebrauchsmuster) DT-GM 76 18 210. This apparatus is used to form the trench with its cutting tool held vertically. German utility model (Gebrauchsmuster) DT-GM 18 97 894 describes a machine in which the tool can assume a given angle relative to the tracks of the vehicle.

With such systems, a difficulty has been uncovered when it is desired to propel the vehicle with the tool in engagement with the ground. If the tool is vertical, for example, any movement of the chassis by driving the tracks puts a considerable strain on the boom and cutting head and reduces the excavating efficiency since normally only the lower end of the tool can effect a maximum degree of cutting, the remainder of the tool forming primarily a detritus-removal operation or, at best, operates as a cutter with reduced effectiveness.

OBJECTS OF THE INVENTION

It is the principal object of the present invention to provide an improved trench-excavating machine which avoids the disadvantages of earlier systems such as those described and can improve the trench-excavating rate.

Another object of this invention is to provide a highly versatile trench excavator which can effect the cutting of trenches in the ground with a minimum of stress upon stress-sensitive components.

SUMMARY OF THE INVENTION

These objects and others which will become apparent hereinafter are attained, in accordance with the present invention, in a trench-excavating machine which comprises a self-propelled chassis carried by tracks and provided with a drive means for these tracks, a turntable rotatable on this chassis about a vertical axis, a boom mounted on the turntable for swinging movement in a vertical plane about a horizontal axis, and a cutting head swingable about a horizontal axis at the free end of this boom and provided with a cutting tool rotatable about an axis perpendicular to the axis about which the head can swing.

According to the invention, between the cutting head and the drive for the tracks of the vehicle means is provided for controlling the drive torque as a function of the inclination of the axis of rotation of the tool and hence at least in part the angle of tilt of the cutting head about its horizontal axis.

The control means of the present invention thus regulates the torque applied by the drive means to the tracks and hence the speed of the vehicle as a function of the orientation of the cutting tool.

Advantageously, the cutting device or head is swingably mounted on the underside of the boom. It has been found to be especially advantageous, in this connection, to mount the cutting head swingably upon a further turntable which is rotatable about a vertical axis and which depends from the underside of the free end of the boom.

The cutting head, depending upon the orientation of the tool, must apply an axial and radial cutting pressure to the tool and best results have been determined to depend upon a distribution of the radial and axial components of force which are applied to the head.

According to the invention, therefore, the control means is so constructed and arranged that the drive moment (force×distance) of the vehicle is the smallest when the axis of the tool is vertical and increases as the angle of the axis of the tool to the ground plane decreases as the tool is swung toward inwardly, i.e. toward the tracks and the chassis. In this case, the machine can be operated so that the maximum axial force applied to the tool is about 30 megapond (Mp) corresponding to 30 million kg-force while the radial pressure is held constant at 10 Mp.

Thus, the torque applied to the tracks can be controlled with respect to the inclination of the axis of the tool to obtain this resolution of the force components, the resultant having been found to give optimum cutting efficiency.

The swinging movement of the cutting head can be effected in various ways, e.g by piston-and-cylinder arrangements, rotary hydraulic motors and the like.

In a preferred embodiment of the invention, the control device includes a position sensor the output of which is a function of the angular orientation of the cutting head. Such a position sensor is preferably a rotary potentiometer whose output represents the angle of inclination of the cutting head.

When the machine is not operated on perfectly horizontal ground, it is important, in ascertaining the angle of attack of the tool, to take into consideration the tilt of the surface upon which the machine travels. In this case, the machine is provided with an electronic tilt detector or plumb bob which provides, for the control circuit, an input representing the tilt of the machine.

It is also possible, especially when a hydraulic cylinder is provided between the cutting head and the boom for tilting the cutting head, to use this cylinder as the angle-measuring device.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 3:
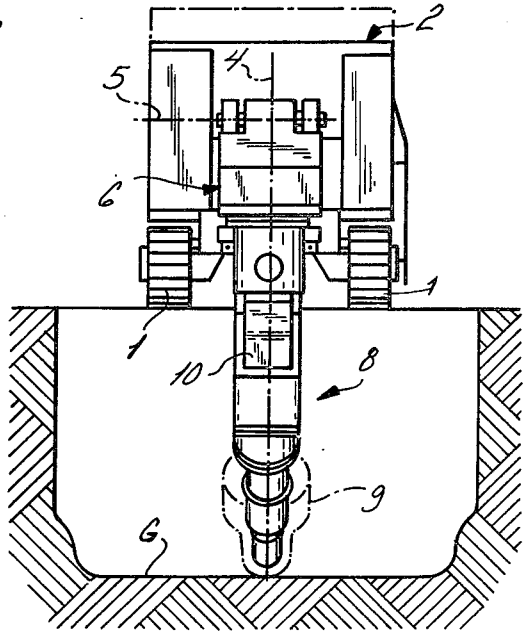
FIG. 3 is a front view.
Figure 1:
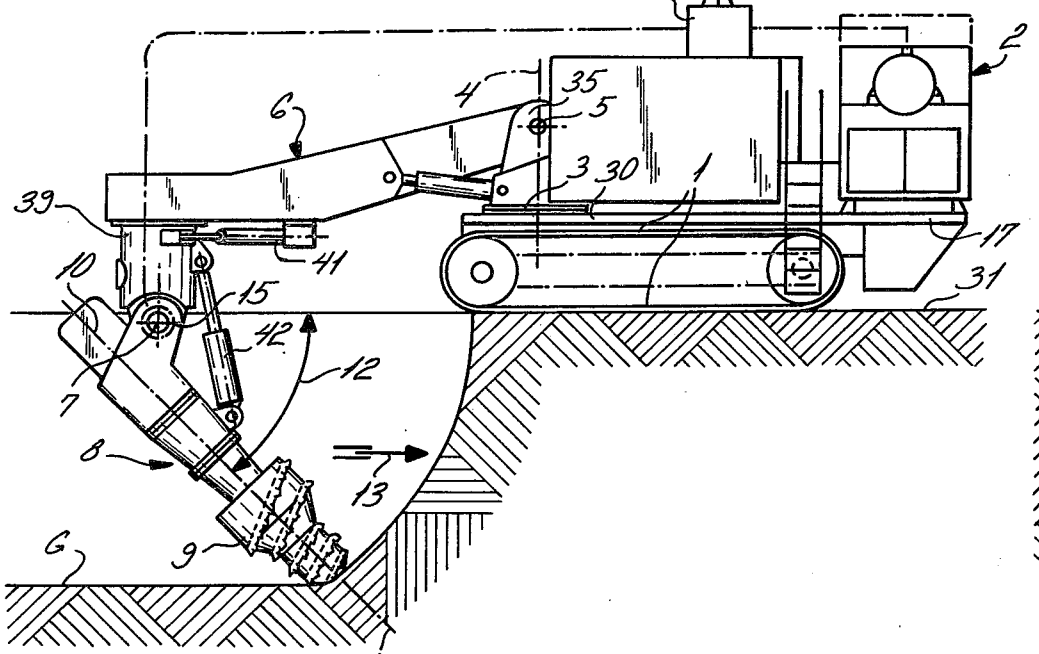
FIG. 1 is a diagrammatic side-elevational view of a trench-excavating machine according to the invention.

The machine illustrated in the drawing is used to excavate a trench G as can be seen at the left-hand side of FIG. 1. The machine comprises a chassis which has been generally represented at 30 and which is propelled along the ground surface 31 by a pair of tracks 1. The chassis 2 carries, upon a counter-balancing extension 17 of the chassis, a prime mover which is generally represented at 2 and can be a Diesel engine with associated pumps, electrical generators or the like.

Figure 2:
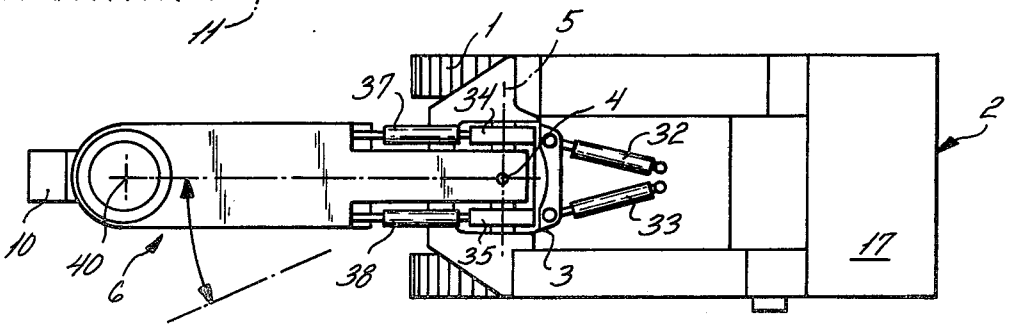
FIG. 2 is a plan view of the machine.

At the opposite end of the chassis, there is provided a turntable 3 which is rotatable about a vertical axis 4 and carries a boom 6, the latter being swingable about a horizontal axis 5. More particularly, the turntable 3 is connected to a pair of diagrammatically illustrated cylinders 32 and 33 which rotate the turntable in opposite senses about the axis 4, i.e. in the counterclockwise and clockwise senses as viewed in FIG. 2.

The boom 6 is pivotally supported by a pair of trunnions 34 and 35 which define the axis 5 previously mentioned and can be raised and lowered by the hydraulic cylinders 37 and 38 pivotally connected to the boom.

At the free end of the boom 6, a cutting head 8 is swingable about a horizontal axis 7. The cutting head 8 carries a tool 9 which is rotatable about the axis 11 by an electric or hydraulic motor 10. More particularly, the boom 6 carries a turntable 39 which is rotatable about a vertical axis 40 by a hydraulic cylinder 41, the turntable 39 forming the pivot 7 for the cutting head 8. The tilt of axis 11 is controlled by a hydraulic cylinder 42.

As can be seen from FIG. 1, the cutting head 8 is disposed beneath the boom 6. The cutting head can be swung from a vertical position of its axis 11 in the direction of the arrow 12 toward the chassis of the vehicle. The feed direction of movement of the vehicle is represented at 13 and the pressing force which is applied by the vehicle to the cutting head is thus resolved into a horizontal component and a vertical component.

The apparatus also includes a control device 14 which regulates the drive force of the vehicle as a function of the angular position of the axis 11 of the cutting head in the manner described above.

The control device 14 is supplied with an input representing the angular position of the head 8 from a rotary potentiometer (see pages 44 ff of *Servomechanism Practice,* McGraw-Hill Book Co., New York, 1960), one of the rotary elements of which is connected to the head at the pivot 7 while the other is connected to the boom. The control device 14 also includes an electronic tilt-measuring unit 16, i.e. an electronic plumb bob, which feeds a corresponding signal to the control circuit.

The cutting tool 9 is provided with milling cutters or teeth which extend along a spiral or helical pattern and thus form a worm conveyor carrying the detritus away from the milling cutter at the tip of the tool in a direction counter to that represented by the arrow 13.

The engine and other drive components represented at 2, by being located on the rearward extension 17 of the chassis, counterbalance the boom and the cutting head.

Naturally, the input to the control circuit 14 can be derived from some other measurement of the position of the head 8. In this case, for example, the stroke of the piston arrangement 42 can be used. To this end a linear variable differential transformer of the type described at page 68 of SERVOMECHANISM PRACTICE can be employed.

One element of the linear differential variable transformer can be connected to the piston while the other is connected to the cylinder.

The extension of the cylinder arrangement 42 thus serves as a measure of the inclination of the head.

Figure 4:
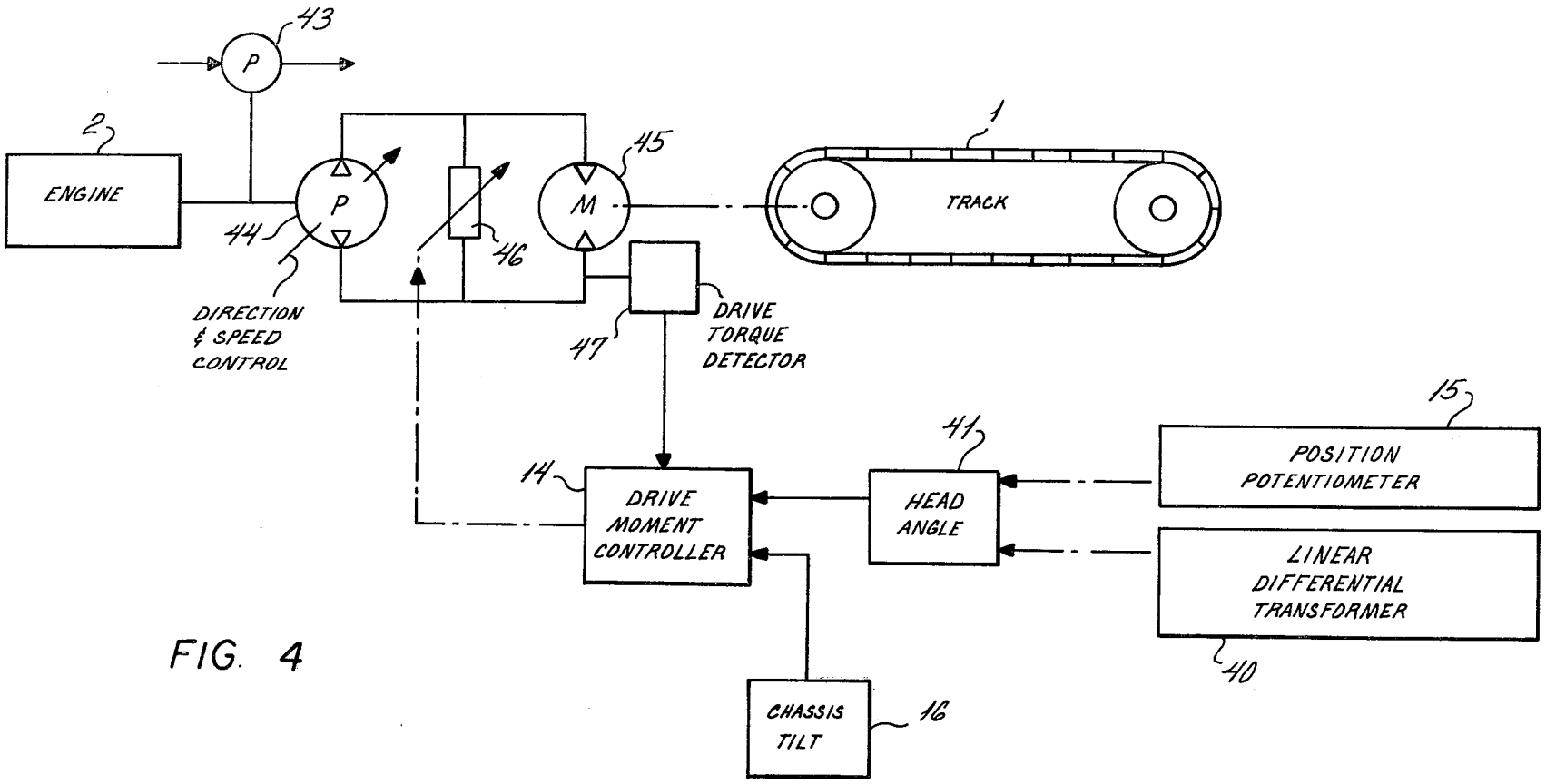
FIG. 4 is a block diagram illustrating a feature of the control system of the invention.

In FIG. 4 the control system has been shown diagrammatically but in somewhat greater detail and can be seen to include the position potentiometer 15 and the linear differential variable transformer 40 which serve as the inputs for the cutting head angle 41 to the drive moment controller 14. The chassis tilt indicator 16 is also connected thereto.

The engine 2 of the machine can drive a pump 43 which can supply all of the hydraulic systems of the apparatus and a variable displacement pump 44 controlling the direction and speed of the tracks 1. A hydraulic motor 45 is connected to the tracks so that the pump 44 and the motor 45 constitute a hydrostatic transmission. To control the torque and the drive force, a shunt valve 46 is connected across the motor and is controlled by the controller 14 which also receives an instantaneous value from the drive torque detector 47.

In accordance with conventional servomechanism practices as discussed in the last-mentioned work, the servomechanism 47, 14, 46 controls the torque and hence the drive moment in dependence upon the angle of the cutting head.

I claim:

1. A trench-excavating machine comprising, in combination:

a chassis having tracks for propelling the chassis along the ground and a drive connected to said tracks;

a turntable mounted on said chassis and swingable about a vertical axis;

a boom mounted on said turntable for swinging movement about a horizontal axis thereon;

a cutting head swingable on the free end of said boom about a horizontal axis, said cutting head being formed with a cutting tool rotatable about an axis substantially perpendicular to the swinging axis of said cutting head; and control means responsive to the inclination of said axis of said tool relative to the ground and controlling said drive for varying the drive force in dependence upon the inclination of said head.

2. The machine defined in claim 1 wherein said head is swingably mounted on the underside of said boom.

3. The machine defined in claim 1 wherein said control means includes a rotary potentiometer connected between said boom and said head for detecting the inclination of said axis of said tool.

4. The machine defined in claim 1 wherein said control means includes level-sensing means responsive to the tilt of the ground upon which said chassis rides.

5. The machine defined in claim 1, further comprising a piston-and-cylinder arrangement connected between said head and said boom for tilting said head relative to said boom, said control means being responsive to said piston-and-cylinder arrangement.

6. The machine defined in claim 1, further comprising a turntable on the free end of said boom swingable about a vertical axis, said head being swingably mounted on said turntable at said free end of said boom below the latter, said control means including position-measuring means responsive to the inclination of said head.

7. The machine defined in claim 6 wherein said tool is formed with a substantially spiral array of teeth forming a conveyor for detritus excavated from a wall of said trench.

* * * * *